US007887643B2

(12) United States Patent
Stelzer et al.

(10) Patent No.: US 7,887,643 B2
(45) Date of Patent: Feb. 15, 2011

(54) DISHWASHER WITH COUNTER-CONVECTION AIR FLOW

(75) Inventors: Walter G. Stelzer, Pewaukee, WI (US); Mark E. Brewer, West Allis, WI (US); Kenyon A. Hapke, Libertyville, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 1079 days.

(21) Appl. No.: 11/108,525

(22) Filed: Apr. 18, 2005

(65) Prior Publication Data

US 2006/0231122 A1 Oct. 19, 2006

(51) Int. Cl.
*B08B 3/00* (2006.01)

(52) U.S. Cl. ..... 134/56 D; 134/57 D; 134/58 D

(58) Field of Classification Search ..... 134/56 R, 134/56 D, 57 R, 57 D, 58 R, 58 D
See application file for complete search history.

(56) References Cited

U.S. PATENT DOCUMENTS 3,513,567 A * 5/1970 Paul ..... 34/233
3,739,145 A 6/1973 Woehler
3,807,420 A * 4/1974 Donselman et al. ..... 134/114
3,908,681 A * 9/1975 Schimke et al. ..... 134/95.2
4,098,616 A 7/1978 Dorius et al.
4,195,419 A 4/1980 Quayle
4,247,158 A 1/1981 Quayle
4,268,973 A 5/1981 Jezuit et al.
4,326,552 A 4/1982 Bleckmann
4,657,036 A 4/1987 Yake
5,341,827 A * 8/1994 Kim ..... 134/107
5,524,358 A * 6/1996 Matz ..... 34/275
5,660,195 A * 8/1997 Taylor et al. ..... 134/58 D
5,881,746 A * 3/1999 Buser et al. ..... 134/58 D
6,053,185 A 4/2000 Beevers
6,622,754 B1 * 9/2003 Roth et al. ..... 134/18

FOREIGN PATENT DOCUMENTS

JP 1-280434 * 11/1989
JP 8-215127 * 8/1996
JP 8-215128 * 8/1996
JP 2003180599 * 7/2003

OTHER PUBLICATIONS

Machine Translation of JP 8-215128.*

* cited by examiner

*Primary Examiner*—Michael Kornakov
*Assistant Examiner*—Eric Golightly
(74) *Attorney, Agent, or Firm*—Boyle Fredrickson, S.C.

(57) ABSTRACT

A dishwasher provides forced air flow in a counter-convectional direction so as to exhaust air out of a bottom portion of the washing volume in contrast to normal convective air flow.

12 Claims, 3 Drawing Sheets

DISHWASHER WITH COUNTER-CONVECTION AIR FLOW

CROSS-REFERENCE TO RELATED APPLICATIONS

--

STATEMENT REGARDING FEDERALLY SPONSORED RESEARCH OR DEVELOPMENT

--

BACKGROUND OF THE INVENTION

The present invention relates to dishwashers and in particular to dishwashers providing forced air flow during the drying cycle.

Dishwashers, such as those used in a home, may provide for a washing cycle followed by a drying cycle, the latter intended to dry the washed dishes sufficiently so that they may be immediately removed from the dishwasher and stored without additional manual drying. In many cases, the drying cycle includes activation of a heating element exposed at the bottom of the washing volume to heat the dishes and create an upward convective flow of hot air.

Improved drying of the dishes during the drying cycle can be obtained by venting the washing volume using vents typically located at the bottom edge of the dishwasher door and through the door near the top of the door. The vents allow cooler dry air to enter the dishwasher volume at the bottom of the door, drawn by the convective air flow, and heated moist air to be discharged through the door near its top.

One drawback to vents is that they can increase the noise emitted from the dishwasher during the washing cycle and accordingly, it is known to provide for vents having an electrically actuable door that may block the vents during the washing cycle thereby cutting emitted noise. One vent of this type is described in U.S. Pat. No. 6,293,289 entitled: "Surge Pressure Vent For Low Noise Dishwasher". Venting can also be obtained by partially opening the door at the conclusion of the washing cycle as disclosed in U.S. Patent Application US 2004/0163684 entitled: "Automatic Door For Dishwasher". Both of these patents are assigned to the assignee of the present invention and hereby incorporated by reference.

Venting systems can be improved by the addition of a blower to increase the passage of air through the washing volume. Generally such blowers are arranged to reinforce the natural convective flow of air thereby obtaining the benefit from the blower and the convection action of the heater used during the drying cycle.

BRIEF SUMMARY OF THE INVENTION

The present inventors have discovered that a blower directed to promote counter-convective air flow downward through an opening near the bottom of the dishwasher volume provides significantly improved dish drying with relatively low air flow. Although the inventors do not wish to be bound by a particular theory, this improvement results from a concentration of water vapor near the bottom of the dishwasher volume because of the relatively greater density of water vapor with respect to air. Downward air flow thus quickly expels the water vapor reserving the drier, heated air near the top of the washing volume which continues to absorb water as it eventually flows downward together with new dry air pulled in from the room at the top of the washing volume. The method appears to work with relatively low air flow volumes which may prevent undue mixing of possibly stratified air and water vapor.

Specifically then, the present invention provides a dishwasher having a housing forming a washing volume for receiving dishes and including a door openable for access to the washing volume and closeable for containing wash water within the housing. The housing includes a first and second opening communicating between inside and outside of the washing volume where the second opening communicates with the washing volume at an area close to the bottom of the washing volume. A blower operating during the dish drying cycle moves air into the washing volume through the first opening to exhaust air out of the washing volume through the second opening.

Thus it is an object of the invention to preferentially exhaust air near the bottom of the washing volume to rapidly eliminate water vapor, improving the drying of the dishes.

The first opening may be a vent near the top of the washing volume, for example, in the roof of the housing.

It is thus another object of the invention to provide a general downward flow of air within the washing volume to take advantage of drier air near the top of the washing volume for absorbing additional moisture.

It is thus another object of the invention to provide an inlet area for air significantly removed from exhausted water vapor that may exit near the lower edge of the door.

The first opening may be a vent in the door.

It is thus another object of the invention to work with standard vent systems that provide ready access to the air inlet area.

The first opening may be between the door and a housing caused by partial opening of the door.

It is thus another object of the invention to further improve dish drying capabilities provided in high end dishwashers that use automatic door opening to augment dish drying.

The second opening may be at a lower edge of the door.

It is thus another object of the invention to work with exiting vent structures which often use venting near this door edge.

The second opening may be a trap blocked by standing water in the washing volume during the wash cycle and unblocked by removal of the standing water during the drying cycle.

It is thus another object of the invention to provide improved efficiency in drying of dishes while cutting noise transmission during dishwashing.

A filter may be provided at the first opening to filter air received within the washing volume.

It is thus an object of the invention to prevent material introduced in the downward air stream from settling on the dishes.

The blower may be positioned at the first opening.

Thus it is another object of the invention to remove the blower from standing water that may be contained in the washing volume.

The blower may be on the outside of the housing.

It is thus another object of the invention to remove the blower from water spray.

The second opening may communicate with the outside of the housing at an area proximate to the floor.

It is thus another object of the invention to divert moist and heated air away from the operator's face and hands.

The blower may have a flow rate of less than ten cubic feet per minute.

It is thus another object of the invention to provide an air flow that does not promote turbulence within the washing volume.

The washing volume may not include an exposed air heater.

It is thus another object of the invention to eliminate standard convective flow that may work against the flow induced by the present invention and to reduce the costs and disadvantages of an exposed hearing element.

These particular objects and advantages may apply to only some embodiments falling within the claims and thus do not define the scope of the invention.

DETAILED DESCRIPTION OF THE PREFERRED EMBODIMENT

Figure 1:
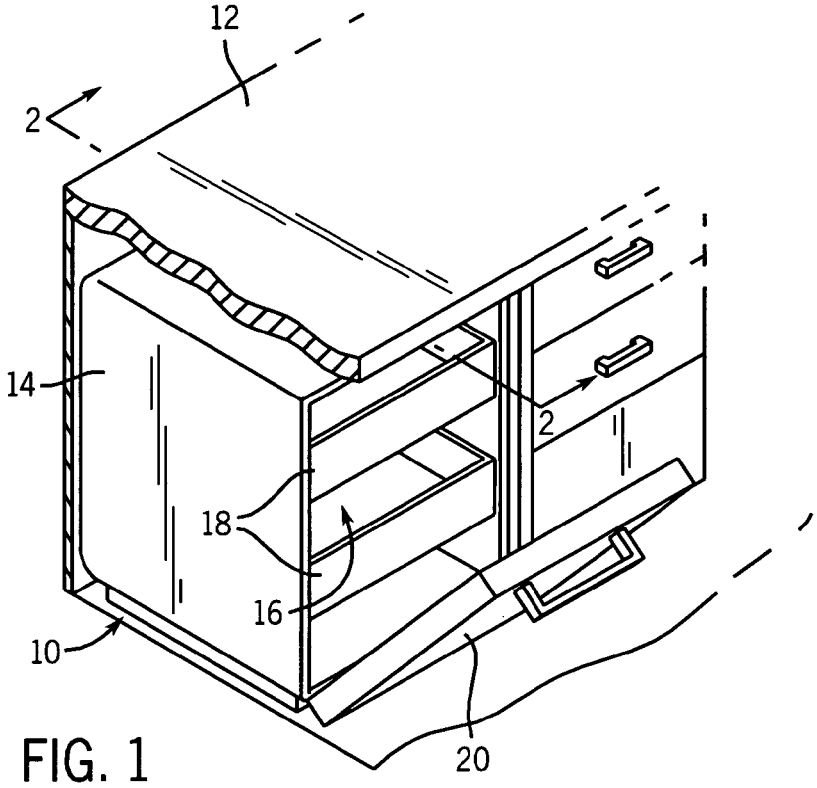
FIG. 1 is a perspective view of a standard residential dishwasher as positioned beneath a counter, the latter shown in cutaway and with the door opened.
Figure 2:
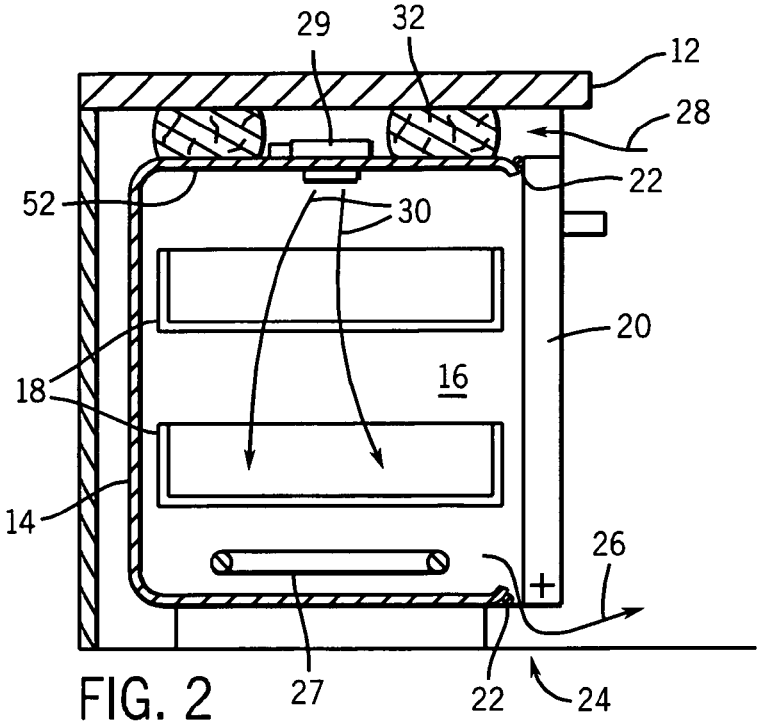
FIG. 2 is a cross-sectional view through the dishwasher of FIG. 1 along lines 2-2 of FIG. 1 showing the door closed and a first embodiment of the invention providing counter-convection air flow using a top mounted intake fan.

Referring now to FIG. 1, a dishwasher 10 for fitting beneath a countertop 12 may include a cabinet 14 enclosing a washing volume 16. The washing volume 16 may hold one or more racks 18 into which dishes may be loaded for cleaning as accessed through a front opening closeable by a door 20. Referring also to FIG. 2, the door 20 may be closed against door seals 22 so as to contain water within the washing volume 16 during a wash cycle.

During a wash cycle, heated water is sprayed on the dishes within the washing volume 16 by stationary or movable nozzles (not shown). At the conclusion of the wash and rinse cycles as determined by a cycle timer (not shown), water is drained from the lower portion of the washing volume 16 in preparation for drying of the dishes, and in a first embodiment of the invention, a heater element 27 is activated heating the air within the washing volume 16.

At this time the cycle timer activates an air intake fan 29 positioned at a vent opening in a roof 52 of the cabinet 14 drawing intake air 28 from outside the washing volume 16 beneath a countertop 12 to produce a counter-convection or downward air flow 30 within the washing volume 16 with the air ultimately exhausting through the lower vent 24 at the lower edge of the door 20 to flow along the floor as exhaust air flow 26. Notably, no moist air is injected in between the dishwasher 10 and the countertop 12 or under other cabinet areas. The downward air flow 30 serves to preferentially exhaust the air at the bottom of the washing volume 16.

Filtration of the intake air 28 may be provided by sound insulating batting 32, for example, also serving to reduce the sound emitted by the dishwasher 10 and being, for example, a fiberglass mat or the like wrapped around the cabinet 14 and beneath the countertop 12. Alternatively, a dedicated filter to be described can be used.

Figure 3:
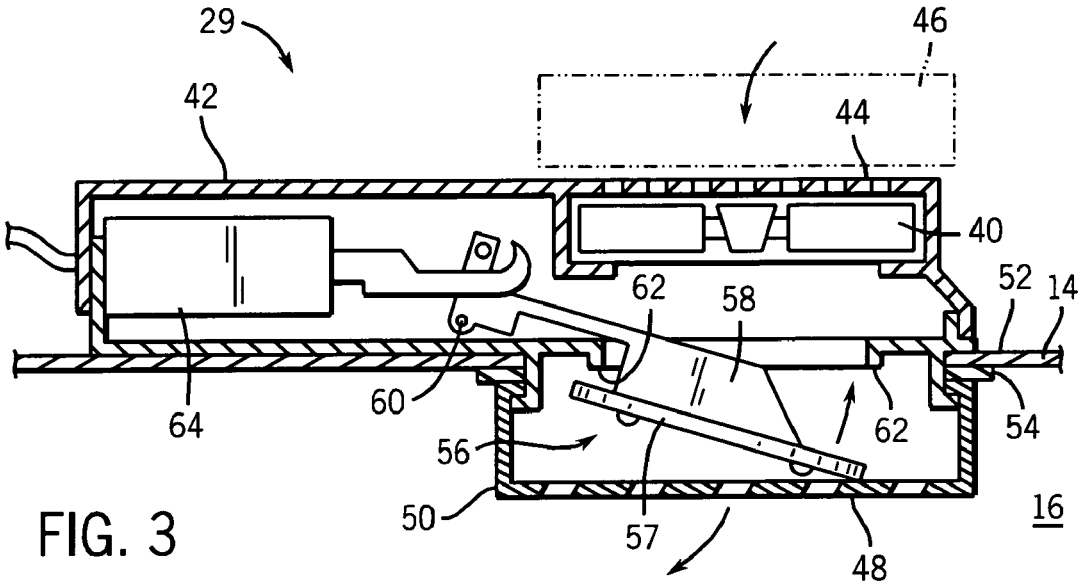
FIG. 3 is a cross-sectional view through the intake fan in the cross-sectional plane of FIG. 2 showing mounting of the fan above an actuator-controlled vent door for reducing noise and shielding the fan from water spray.

Referring now to FIG. 3, the intake fan 29 may include a standard muffin-style propeller fan 40 having an air flow without back pressure of less than ten cubic feet per minute and providing a downward air flow toward the dishwasher 10. The fan 40 may alternatively be other fan styles including squirrel-cage-type fans and, as used herein the terms fan and blower will be used interchangably to indicate any mechanism for moving air at relatively low pressures and velocities as opposed to compressed air jets.

The fan 40 is held within a housing 42 beneath a grate 44 in and at the top of the housing 42. The grate 44 may provide support for an inline filter 46 that may optionally be used instead of or with the filtration provided by the batting 32.

The fan 40 draws air through the grate 44 and directs it downward through the housing, a hole in the roof 52 of the cabinet 14, and a second grate 48 beneath the fan 40.

The second grate 48 is formed by a removable bezel 50 positioned within the washing volume 16. The bezel 50 may twist to lock onto the housing 42 thereby sandwiching the roof 52 of the cabinet 14 and a gasket 54 between the housing 42 and the bezel 50 with the fan 40, and most of the housing 42 and the fan 40 remaining outside of the washing volume 16.

A flapper door 56 is positioned within the housing 42 in the path of air flow. In the preferred embodiment, the flapper door 56 employs an elastomeric disk 57 held on an arm 58 to pivot about an axis 60 so that the flapper door 56 may swing between an open position shown in FIG. 3 and a closed position with the elastomeric disk 57 seating against a seat portion 62 of the housing 42. When the elastomeric disk 57 is in the closed position, it seals the housing 42 so as to close the washing volume 16 from communication with the fan 40 and the air outside of the washing volume 16.

The arm 58 is linked to an actuator 64, such as a wax motor or other electrical actuator, to close the flapper door 56 during the washing cycle under control of the cycle timer thereby reducing noise transmission and protecting the fan 40 and surrounding the cabinet and countertop 12 from water spray, heat, and high humidity. Conversely, the actuator 64 under control of the cycle timer may open the flapper door 56 after the washing and rinse cycles and during the drying cycle when the fan 40 is operating. Wiring to the fan 40 and actuator 64 is not shown in FIG. 3 for clarity.

Figure 4:
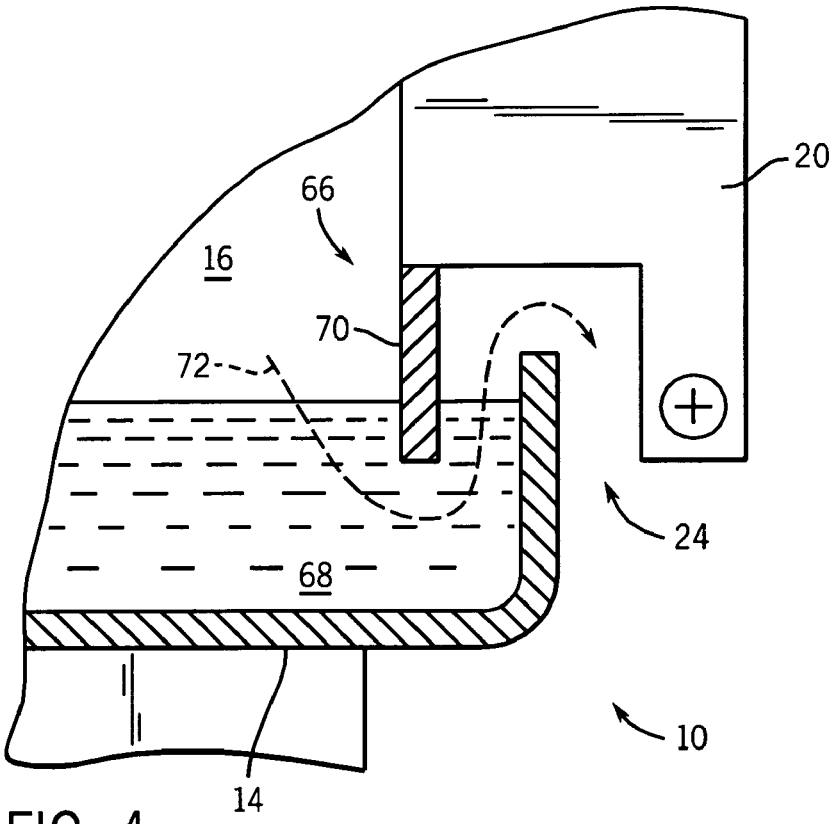
FIG. 4 is a cross-sectional detail view of FIG. 2 showing a lower door corner in an embodiment in which a sound trap is provided at a lower vent by standing water within the washer volume.

Referring now to FIG. 4, effective closure of the lower vent 24 during the washing cycle may be obtained by means of a trap 66 created with standing water 68 at the bottom of the cabinet 14 during the washing cycle. As is known in the art for dishwashers using conventional convection drying, the standing water may rise to a level to cover a lower edge of a trap dike 70 to prevent sound flow around the dike indicated by arrow 72 from inside the washing volume 16 to outside air. Upon conclusion of the wash cycle, when the standing water 68 is drained, this path of arrow 72 is free and exhaust air 26 may exit per the present invention.

Figure 5:
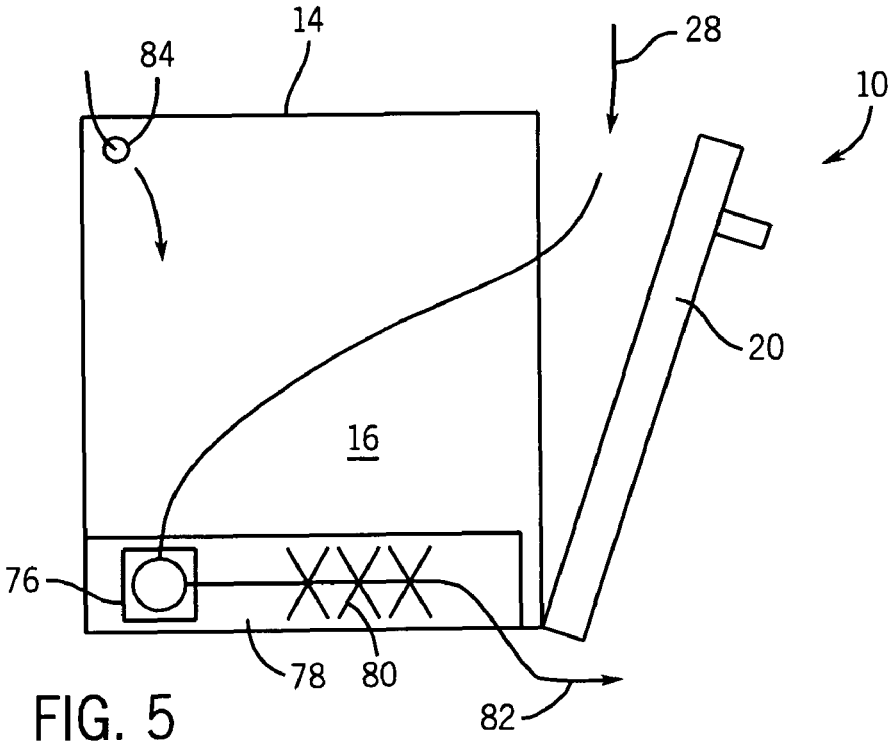
FIG. 5 is a simplified cross-sectional view of the cabinet of FIG. 2 showing alternative air flow paths in another embodiment.

Referring now to FIG. 5 from the above description, it will be recognized to those of skill in the art, that modification may be made to these preferred embodiments. For example, instead or in addition to the fan 29, an exhaust fan 76 may be placed near the bottom of the washing volume 16 to receive air from that lower portion of the washing volume 16 and to exhaust that air to the ambient environment. Fan 76 may include a baffle system and/or an electrically actuatable door for noise control and protection of the fan 76.

In one alternative embodiment, the air may be received into the washing volume 16 through a partial opening between the door 20 and the cabinet 14 in systems that provide for automatic door opening. In this case, the venting opening for the fan 40 may be displaced toward the rear of the cabinet and may provide air to a duct 78 possibly including condensing elements 80 for exit near the front of the dishwasher 10 at floor level as indicated by arrow 82.

Alternatively, air may be received through a vent 84 positioned near the top of the cabinet 14, possibly at a rear upper edge, and may include a conventional baffle system for retaining water or an electrically actuatable door.

Figure 6:
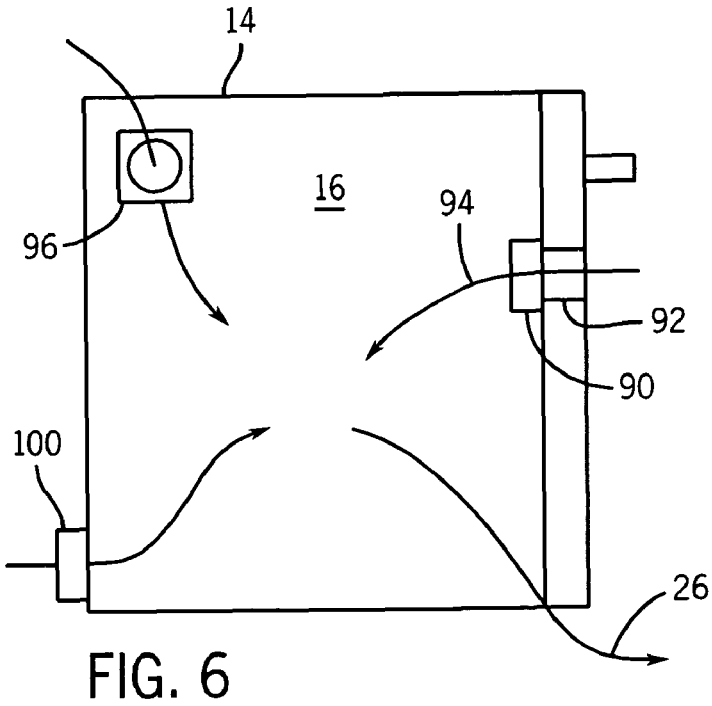
FIG. 6 is a view similar to that of FIG. 5 showing yet additional embodiments with alternate air flow paths.

Referring to FIG. 6, it will be understood that a preferential venting of the moisture laden air near the bottom of the washing volume 16 may also be accomplished with a variety of intake fans, for example, an intake fan 90 positioned on a door vent 92 of otherwise conventional design for drawing in air near the top of the cabinet as indicated by arrow 94. Alternatively, a vent fan 96 may be placed on a side or rear wall of the cabinet 14 at its upper edge.

While not preferred, exhausting of the moisture laden air starting at the bottom of the washing volume 16 can also be accomplished with a fan 100 mounted near the bottom of the washing volume 16 drawing in air to exhaust near the front lower edge of the door 20.

Referring again to FIG. 2 in one embodiment, the heater element 27 may be eliminated and the drying cycle may rely on the heat retained in the dishes themselves and cabinet from the heated water used in the washing cycle together with the counter-convection air flow of the present invention Elimination of the heater element reduces offsetting convective flow, the space and cost required by the heater element 27, the power consumption of the heater element 27 which exceeds that of the fan 40, and the risk of damage to dishes and their components that may be close to or touch the heater element 27.

It is specifically intended that the present invention not be limited to the embodiments and illustrations contained herein, but include modified forms of those embodiments including portions of the embodiments and combinations of elements of different embodiments as come within the scope of the following claims.

We claim:

1. A dishwasher comprising:

a housing providing a washing volume for receiving dishes, the housing including nozzles for spraying wash water within the washing volume, and including a door openable for access to the washing volume and closable for containing wash water within the housing during washing;

one or more racks contained within the washing volume of the housing;

at least a first and second opening in the housing communicating between an outside and inside of the washing volume wherein the second opening communicates with the washing volume at an area proximate a bottom of the washing volume and the first opening communicates with the washing volume at an area proximate to the top of the washing volume above all racks, whereby air flowing from the first opening to the second opening may pass downward across the racks without substantial upward travel throughout an entire flowing pass from the first opening to the second opening a muffin style propeller fan positioned at the first opening and operating during a dish drying cycle to move air into the washing volume through the first opening and to exhaust air out of the washing volume through the second opening wherein the fan is configured to provide a flow rate of less than ten cubic feet per minute through the first and second openings, and a vent door closable over one of the first and second openings in response to an electrical signal applied to a vent door actuator communicating with the vent door to move it between an open and closed position.

2. The dishwasher of claim 1 wherein the first opening is a vent in a roof of the housing.

3. The dishwasher of claim 1 wherein the first opening is a vent in the door.

4. The dishwasher of claim 1 wherein the first opening is between the door and housing caused by partial opening of the door.

5. The dishwasher of claim 1 wherein the second opening is at a lower edge of the door.

6. The dishwasher of claim 1 wherein the second opening is a trap blocked by standing water in the washing volume during a wash cycle and unblocked by a removal of the standing water during the drying cycle.

7. The dishwasher of claim 1 including a filter at the first opening to filter air received within the washing volume.

8. The dishwasher of claim 1 wherein the blower is on the outside of the housing.

9. The dishwasher of claim 1 wherein the vent door is positioned between the blower and the washing volume.

10. The dishwasher of claim 1 wherein the second opening communicates with the outside of the housing at an area proximate to a floor.

11. The dishwasher of claim 1 further including a condenser positioned at the second opening for condensing moisture in air flowing through the second opening.

12. The dishwasher of claim 1 wherein the washing volume does not include an exposed air heater.

* * * * *